United States Patent [19]

Winkelblech

[11] 4,427,094

[45] Jan. 24, 1984

[54] PORTABLE ELEVATOR DEVICE

[76] Inventor: Dean R. Winkelblech, Aronsburg, Pa. 16820

[21] Appl. No.: 282,265

[22] Filed: Jul. 10, 1981

[51] Int. Cl.[3] ..... B66B 9/20

[52] U.S. Cl. ..... 187/9 R; 187/12; 187/17; 187/24; 187/25; 182/148

[58] Field of Search ..... 187/12, 17, 24, 25, 187/9 R; 182/17, 141, 148, 63; 248/125, 157

[56] References Cited

U.S. PATENT DOCUMENTS

| | | | |
|---|---|---|---|
| 2,843,430 | 7/1958 | Johnson | 182/17 X |
| 2,895,567 | 7/1959 | Hall | 187/24 |
| 3,871,477 | 3/1975 | Kuest | 182/63 |
| 4,324,317 | 3/1982 | Winkelblech | 187/25 |

FOREIGN PATENT DOCUMENTS

| | | | |
|---|---|---|---|
| 885824 | 12/1961 | United Kingdom | 187/9 |

*Primary Examiner*—Joseph J. Rolla
*Assistant Examiner*—Thomas C. Fitzgerald
*Attorney, Agent, or Firm*—Thomas E. Sterling

[57] ABSTRACT

This invention is an electrically powered movable elevator device comprised of a base mounted on wheels upon which is mounted a substantially vertical hollow support member through which a screw passes. A support nut attaches to a platform and engages the screw. An electrical control system attached to the platform allows a person standing thereon to be raised or lowered by the rotation of the screw. A reversible electric motor is belt-coupled to the screw which may be made to rotate in either direction, by the electrical control system.

4 Claims, 8 Drawing Figures

PORTABLE ELEVATOR DEVICE

This invention relates to elevators and in particular to portable elevators which may be easily moved from place to place.

Many of man's construction and repair activities require that he be elevated to a certain height in order to reach areas where he is to work. This need has been fulfilled by the stepladder, the extension ladder and other like devices which permit a person to elevate himself into the air. Many of these ladder deviced must be transported from place to place then set up, frequently leaning upon walls or other supports, for operation. Such ladders or lifting devices are oftentimes dangerous, necessitate the operator to climb upwardly to a precarious height and depend for support upon walls, or other supporting objects. It is the purpose of this invention to provide an elevator or lift which can be easily wheeled to the area of use and then lift the operator from the ground to the desired height.

Essentially this invention is comprised of a wheeled platform, that is a platform having wheels thereon. Mounted on this platform is a vertical structure containing a screw which may be rotated by an electric motor belt-coupled to the screw. A foot platform is coupled to the screw by means of a rotating nut and upon rotation of the screw the platform will either be raised or lowered. An electrical elevator control is mounted on the elevating platform whereby the operator may control the electric motor to rotate clockwise or counter clockwise, making the platform go up or go down. The wheeled legs on the platform may be extended outwardly in a tube-telescoping fashion to allow a broader base of support for the elevator device so that the device will not tip over.

PRIOR ART STATEMENT

The inventor knows of prior art similar to this invention cited in connection with his pending patent application Ser. No. 115,713, filed Jan. 28, 1980, entitled ELEVATOR DEVICE. Attention is drawn to this Application and to the reference patents cited by the Patent and Trademark Office in the prosecution thereof.

An object of this invention is, therefore, to provide a portable and movable elevator device which may be easily moved to a position of use and there to lift a person to an elevated position and to lower him therefrom.

Another object of this invention is to provide a portable elevator device, the legs of which may be extended to provide a broader base of support for the elevator device.

Another object of this invention is to provide a portable screw activated elevator powered by an electrical motor.

Still another object of this invention is to provide an elevator device mounted on a wheeled platform that may be easily moved from place to place and operated while resting on the wheels.

Yet another object of this invention is to provide a portable lifting device which may be operated by an external electrical power source or a battery.

Other objects and novel features of construction will appear from the following description taken in conjunction with the accompanying drawings.

Figure 3:
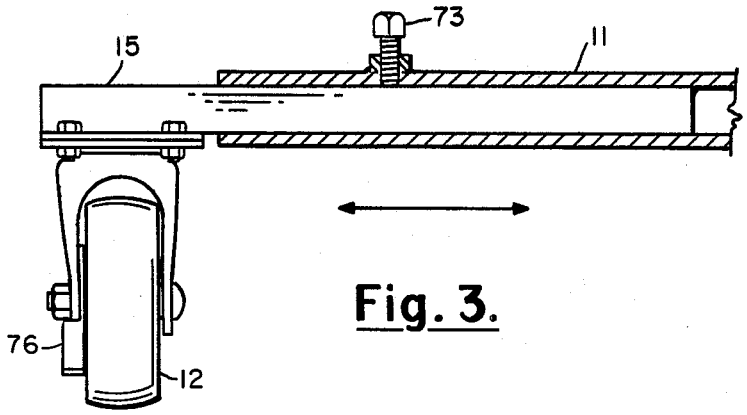
FIG. 3 is a cross-sectional view taken along lines 3—3 of FIG. 1.
Figure 1:
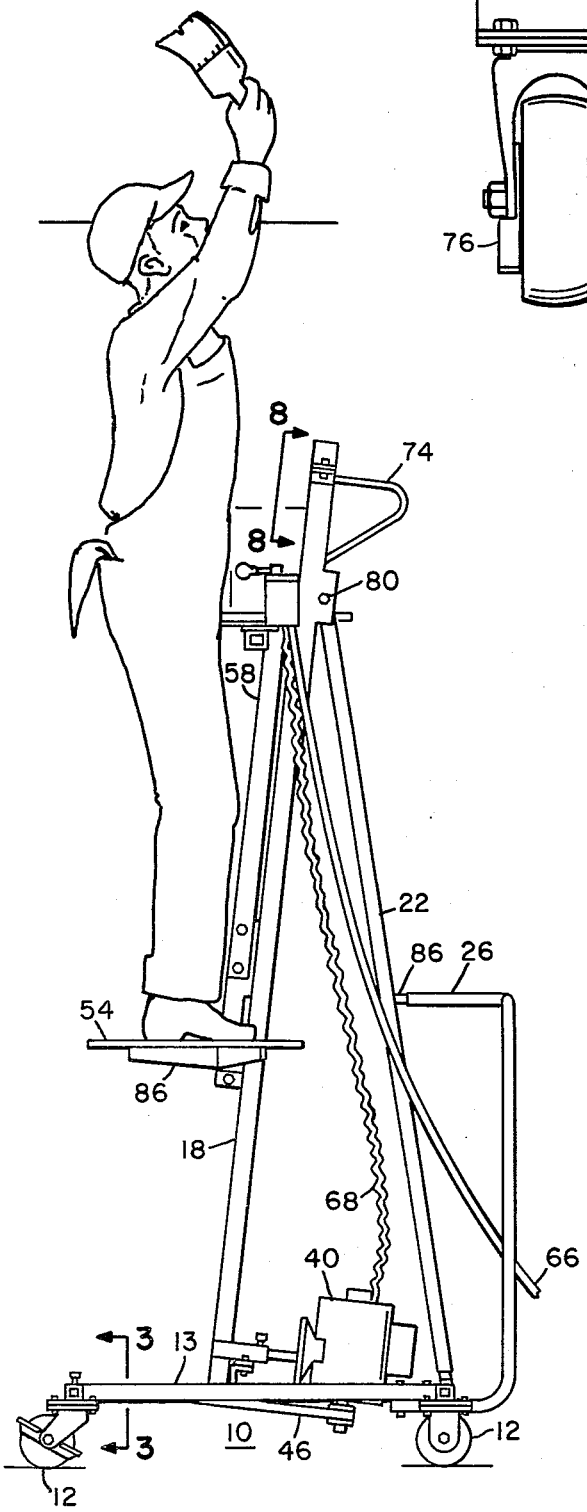
FIG. 1 is a side view of the portable elevator device showing a man standing on the lift platform.
Figure 2:
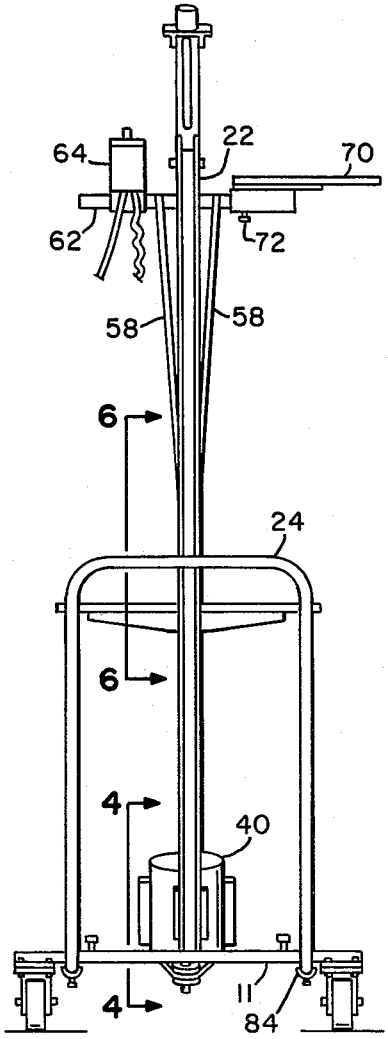
FIG. 2 is a front view of the portable elevator device.
Figure 5:
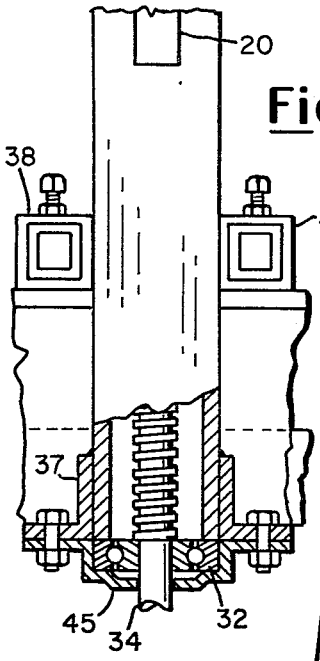
FIG. 5 is a front view, partially in cross-section, taken along lines 5—5 of FIG. 4.
Figure 4:
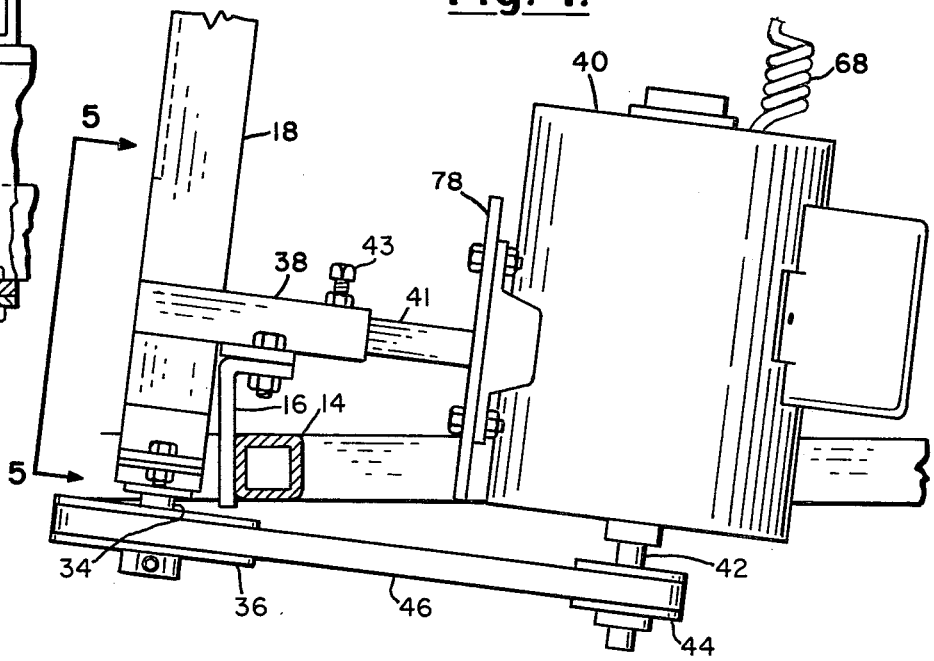
FIG. 4 is an enlarged side view of the electric motor of the device coupled with the screw mechanism.
Figure 8:
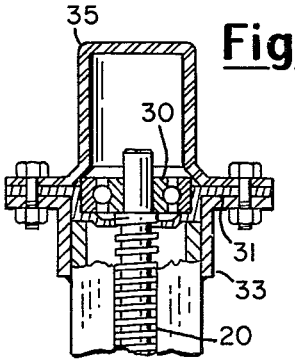
FIG. 8 is a cross-sectional view of the top portion of the screw mechanism of the device.
Figure 7:
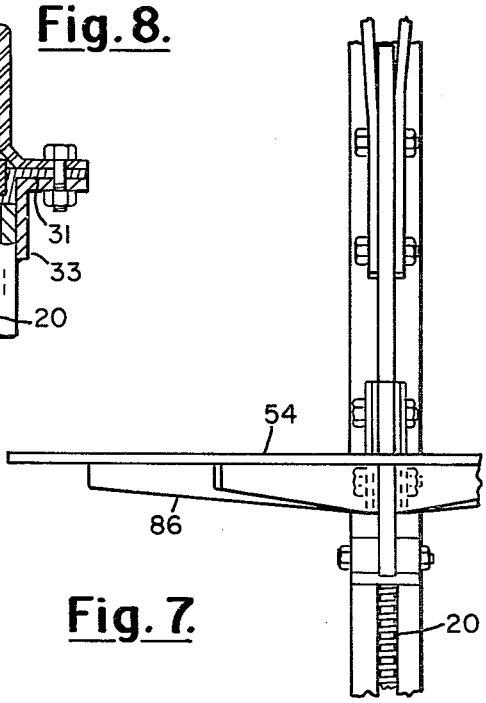
FIG. 7 is a rear view of the device showing the platform thereon.
Figure 6:
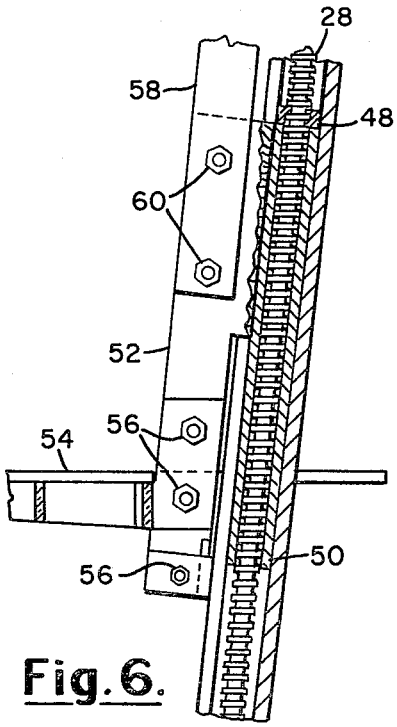
FIG. 6 is a side view, partially in section, of the rotating screw mechanism of the device.

Referring to the drawings, and in particular to FIGS. 1 and 2, 10 represents the rectangular base of the elevator device comprised of front and rear members 11 and side members 13 describing a rectangle. Two front and two rear wheels 12 are positioned at the outward extension of front and rear members 11 of the rectangle. A cross member 14 extends between the side members 13. Upon cross member 14 is positioned an L-shaped bracket 16. A substantially vertical screw enclosing member 18 is attached to bracket 16 by means of bolts. Screw enclosing member 18 extends substantially vertically and is essentially a hollow cylinder having approximately a square cross section. A vertical slot 20 extends the length of screw enclosing member 18. A vertical member 22 is attached to front member 11 of the base 10 and extends to the upper portion of screw enclosing member 18 where it is attached by means of a pin 80. An inverted U-shaped member 24 is attached to the forward end of front member 11 and extends upwardly therefrom. U-shaped member 24 may be hand grasped to push or pull the unit into place. A horizontal member 26 extends from the upper portion of U-shaped member 24 to vertical member 22 and supports it in position. Screw 28 is positioned within screw enclosing member 18 and extends the length therethrough. Screw 28 is supported at the top of screw enclosing member 18 by upper bearing 30 and at the bottom of screw enclosing member 18 by lower bearing 32. Screw 28 rotates within these bearings. Upper bearing 30 is positioned upon upper bearing support 31 which is bolted to upper support flange 33 integrally attached to the upper portion of screw enclosing member 18. A cylindrical cap 35 covers the top portion of screw enclosing member 18 and is bolted to upper bearing support 31 and support flange 33. A lower portion of screw 28 extends through lower bearing 32 in the bottom of screw enclosing member 18 as shaft 34 upon which is positioned pulley 36. Lower bearing 32 is supported by lower bearing cap 45 which is bolted to a lower support flange 37 integrally attached to the bottom portion of screw enclosing member 18.

Rear wheels 12 are bolted to two extension members 15 which slide into the rectangular hollow cross section of rear members 11. Rear wheel brakes 76 positioned on rear wheels 12 lock on foot pressure and lock rear wheels 12 allowing the elevator to be anchored in a stationary position. A rear member thumb screw 73 extends through and screw engages rear member 11 and bears against extension member 15 securing it in position. Each of rear wheels 12 is adapted to pivot and turn sideways independently so that the rear of the device may be moved sideways allowing easy steering and positioning.

A reversible electric motor 40 is attached to screw enclosing member 18 by means of two adjustable motor brackets 38. Motor brackets 38 are adjustable permitting motor 40 to be moved and clamped in position.

The two motor adjusting brackets 38 are welded on either side of the screw enclosing member 18. Each is comprised on an outer shell having a hollow central portion. Two motor adjusting members 41 are welded to a motor mounting plate 78 which is bolted to electric motor 40. Motor adjusting members 41 slides within motor adjusting brackets 38. The electric motor 40 then may be moved outwardly till the proper tension on belt 46 is obtained. Two motor clamping screws 43 extend through brackets 38 and upon tightening bear against motor adjusting members 41 securing them in position.

Motor shaft 42 extends from the bottom portion of electric motor 40 and has mounted thereon motor pulley 44. A belt 46 extends around motor pulley 44 and about screw pulley 36 whereby the rotation of motor shaft 42 will cause rotation of screw 28.

A nut 48 positioned within screw enclosing member 18 engages the screw 28. Rectangular shaped inner slide 50 is integrally attached to nut 48 and encases screw 28. Inner slide 50 is in sliding contact with the interior portion of screw enclosing member 18 and will slide upward or downward within screw enclosing member 18. Inner slide plate 52 is welded to inner slide 50 and passes through vertical slot 20 in screw enclosing member 18. A foot platform 54 is bolted to inner slide plate 52 by means of platform bolts 56 whereby foot platform 54 is held substantially in a horizontal position. Dual control arm supports 58 are bolted to inner slide plate 52 by bolts 60. The dual control arm supports 58 are attached to a horizontally positioned control arm 62 positioned at about waist height above the foot platform 54. An elevator control switch 64 is integrally attached to control arm 62. Power cable 66 connects to elevator control switch 64 to a power outlet (not shown). A spiralled control cable 68 extends from control switch 64 downwardly and connects to motor 40. The operation of elevator control switch 64 in the up position will transmit electric power to motor 40 causing it to rotate to drive screw 28 to lift foot platform 54 upwardly. The operation of control switch 64 to the down position will cause foot platform 54 to lower. Cable 66 is attached to a nearby power outlet (not shown) generally of 110 or 220 volts. A storage battery (not shown) may also be connected to cable 66 to power electric motor 40 which is then adapted to utilize storage battery electrical current. The side of control arm 62 opposite to the control switch 64 has positioned thereon a removable shelf 70 upon which tools, paint and other paraphernalia used by the operator may rest. Removable shelf 70 slips over control arm 62 and is held in position by thumb screw 72 which extends through removable shelf 70 and bears against control arm 62.

It should be noted that pin 80 extends through both vertical member 22 and screw enclosing member 18 and may be easily removed. Vertical member 22 has a hollow central portion extending through its length which fits into a protrusion extending from the central portion of front member 11. Thus when pin 80 is removed, vertical member 22 may be easily removed. Likewise horizontal member 26 is hollow and encloses extension member 86 which is attached to vertical member 22. Thus vertical member 22 is easily removed from horizontal member 26 and may be disengaged from the elevator device.

Clamps 84 are screw attached to the bottom portion of U-shaped member 24 and to front of member 11. Unscrewing clamp 84 will release U-shaped member 24 and allow it to be removed. Screw enclosing member 18 may be easily disconnected from motor 40 by unscrewing motor clamping screws 43 and the bracket bolts. Hence the device may be easily disassembled into its component parts.

In operation, the elevator device is wheeled to the place of use upon wheels 12 by grasping horizontal member 26 or other portions of the device. Power cable 66 is then connected to a convenient power outlet, thus supplying electric power to the device. The operator steps upon foot platform 54 and places any tools or other equipment on removable shelf 70. The operator then activates elevator control switch 64 to the UP position. Elevator control switch 64 connects the electric power from power cable 66 to motor 40 through spiral control cable 68. Electric motor 40 then turns causing motor shaft 42 and pulley 44 to rotate belt 46 which turns screw pulley 36 and connected screw 28. Screw 28 rotates in upper bearing 30 and lower bearing 31. Nut 48 engaging screw 28 will then begin to raise elevating foot platform 54 with it. When the foot platform 54 reaches the desired height the operator turns elevator control switch 64 to the OFF position causing motor 40 and screw 28 to stop. The platform will then remain stationary while the operator does his work. When the operator is finished, he activates elevator control switch 64 to the DOWN position causing the reverse of sequence, and foot platform 54 lowers.

If the operator wishes additional base support for the elevator device, he may extend rear wheels 12 outwardly by pulling the wheels 12 and the attached telescoping arm away from the body of the device. The extended wheels 12 may then be clamped in position by rear member thumb screw 73 extending through the rear member of rectangular base 10. In this way the stability of the elevating device may be markedly improved so that the operator may be elevated to greater heights without danger of the device toppling over.

I claim:

1. A movable elevator device comprising in combination:

a base member;

wheel means attached to said base member;

said wheel means being comprised of, in combination:

a wheel support member adjustably extending within said base member;

a wheel rotatably attached to wheel support member;

braking means connected to said wheel;

a clamping screw extending through said base member and bearing against said wheel support member;

an electric motor adjustably attached to said base member;

a substantially vertical screw rotatably coupled to said electric motor;

a hollow screw enclosing member attached to said base member and enclosing said screw;

a support nut rotatably engaged with said screw;

an inner slide connected to said support nut and in sliding contact with the interior surface of said screw enclosing member;

a foot platform attached to said inner slide;

a control arm connected to said foot platform;

an adjustable shelf means connected to said control arm;

said adjustable shelf means comprised of, in combination:

a shelf having a sleeve thereon, said sleeve encircling said control arm;

a thumb screw extending through said sleeve to bear against said control arm;

an elevator control switch attached to said control arm and in electrical contact with said electric motor; and a power source connected to said elevator control switch.

2. The combination as claimed in claim 1, in which said electric motor is coupled to said screw enclosing member by adjustable means.

3. The combination as claimed in claim 2, having in combination:

a vertical support member connecting said screw enclosing member and said base member;

a removable pin extending through said vertical support member and said screw enclosing member; and a removable slidable means connecting said vertical support member and said base member.

4. The combination as claimed in claim 3, having in combination:

a hand hold member connecting said base member and said vertical support member;

removable screw means attaching said hand hold member to said base member; and removable slidable means attaching said hand hold member to said vertical support member.

* * * * *